US006109277A

United States Patent [19]

Linton et al.

[11] Patent Number: 6,109,277

[45] Date of Patent: Aug. 29, 2000

[54] PARTS WASHER

[75] Inventors: Paul W. Linton, Vancouver, Wash.; Bill George Epperson, Jr., Hillsboro; Hal W. Hardinge, Lake Oswego, both of Oreg.; David Alan Bergerud, Vancouver, Wash.

[73] Assignee: Landa, Inc., Portland, Oreg.

[21] Appl. No.: 08/707,943

[22] Filed: Sep. 10, 1996

[51] Int. Cl.[7] ..... B08B 3/02

[52] U.S. Cl. ..... 134/56 R; 134/58 R; 134/108; 134/179; 134/176; 239/247

[58] Field of Search ..... 134/56 R, 57 R, 134/58 R, 105, 108, 113, 111, 179, 176, 200; 239/243, 247, 253

[56] References Cited

U.S. PATENT DOCUMENTS

| | | |
|---|---|---|
| 1,176,125 | 3/1916 | Benedict . |
| 1,475,489 | 11/1923 | Hicks . |
| 1,502,863 | 7/1924 | Merseles . |
| 1,690,974 | 11/1928 | Hazard et al. . |
| 1,897,821 | 2/1933 | Poli . |

(List continued on next page.)

FOREIGN PATENT DOCUMENTS

| | | |
|---|---|---|
| 263486 | 8/1963 | Australia . |
| 1 293 424 | 4/1969 | Germany . |
| 6-38917 | 2/1994 | Japan . |

OTHER PUBLICATIONS

Landa, Inc., Spin Jet Automatic Parts Washer brochure, 1996.

Cuda Corporation, Automatic Parts Washer brochure.

Citation Industries, Model 7000 Heavy Duty Jet Washer brochure.

The Hotsy Corp., Hotsy Tubs brochure, 1990.

Hydro–Blast, Inc., Automatic Cabinet Parts Washers brochure, 1994.

Better Engineering Mfg., Inc., The Purifiers Jet Washers brochure, 1992.

*Precision Cleaning*, vol. III, No. 8, Sep. 1995.

JBI Industries, Front Load Parts Washers brochure.

Landa Spray Jet Parts Washers brochure, Jan. 1995.

Landa Spray Jet Parts Washer Operator's Manual.

Economite document by Midco International Inc. of Chicago, Illinois.

*Grainger Industrial and Commercial Equipment and Supplies 1995 General Catalog No. 386*, pp. 1554–1556.

*Precision Cleaning*, Sep. 1995, vol. III, No. 8, pp. 10, 15, 44, 50 and 60.

*Primary Examiner*—Frankie L. Stinson

*Attorney, Agent, or Firm*—Kolisch, Hartwell, Dickinson, McCormack & Heuser

[57] ABSTRACT

A parts washer is disclosed. The parts washer includes a housing that has a washbasin defining an inner cavity and chargeable with a volume of fluid. A spray tube is rotatably positioned within the housing and has an axis of rotation. The spray tube is configured to define a volume of rotation as it rotates about its axis of rotation. A support structure configured to support parts to be washed is positioned within the housing and is substantially within the volume of rotation of the spray tube. The parts washer further includes a pump connected to the spray tube. The pump delivers fluid under pressure to the spray tube. The spray tube includes a plurality of outlets configured to direct fluid towards parts to be washed on the support structure and at least one outlet configured to direct fluid in a direction to cause fluid-propelled rotation of the spray tube about its axis of rotation. The parts washer may further include a heater, a first thermostat for measuring the temperature of fluid in the parts washer and automatically disengaging the heater if the temperature of the fluid exceeds a defined maximum temperature, and a second thermostat for controlling the heater to maintain the temperature of fluid in the parts washer between defined upper and lower temperatures. Furthermore, the parts washer may include a pressure switch for disengaging the pump and/or the heater if pressure from fluid in the parts washer is less than a defined minimum pressure. A method for using the parts washer is also disclosed.

33 Claims, 7 Drawing Sheets

U.S. PATENT DOCUMENTS

| | | | |
|---|---|---|---|
| 1,927,665 | 9/1933 | Kirby . | |
| 2,038,260 | 4/1936 | Ash . | |
| 2,078,670 | 4/1937 | Kirby . | |
| 2,177,219 | 10/1939 | Lewis . | |
| 2,320,133 | 5/1943 | Horwitz . | |
| 2,666,439 | 1/1954 | Bechtol . | |
| 2,741,988 | 4/1956 | Merritt . | |
| 2,945,446 | 7/1960 | Mason et al. . | |
| 3,020,918 | 2/1962 | Albertson et al. . | |
| 3,236,249 | 2/1966 | Everoad | 134/179 |
| 3,324,867 | 6/1967 | Freese . | |
| 3,469,586 | 9/1969 | Berson et al. | 134/179 |
| 3,486,782 | 12/1969 | Zanussi . | |
| 3,774,261 | 11/1973 | Colt . | |
| 3,844,299 | 10/1974 | Athey et al. . | |
| 3,896,827 | 7/1975 | Robinson . | |
| 3,971,394 | 7/1976 | Osborne . | |
| 3,985,023 | 10/1976 | Guth | 134/58 DL |
| 4,197,000 | 4/1980 | Blackwood | 134/199 |
| 4,255,079 | 3/1981 | Piegza . | |
| 4,402,333 | 9/1983 | Frizzell et al. | 134/900 |
| 4,641,671 | 2/1987 | Nogi et al. . | |
| 4,995,409 | 2/1991 | Watts . | |
| 5,107,876 | 4/1992 | Ozyjiwsky . | |
| 5,313,964 | 5/1994 | Dausch et al. . | |
| 5,409,023 | 4/1995 | Santarossa et al. . | |
| 5,577,399 | 11/1996 | Whipple, III et al. . | |
| 5,673,714 | 10/1997 | Campagnolo et al. | 134/179 |

Fig. 9
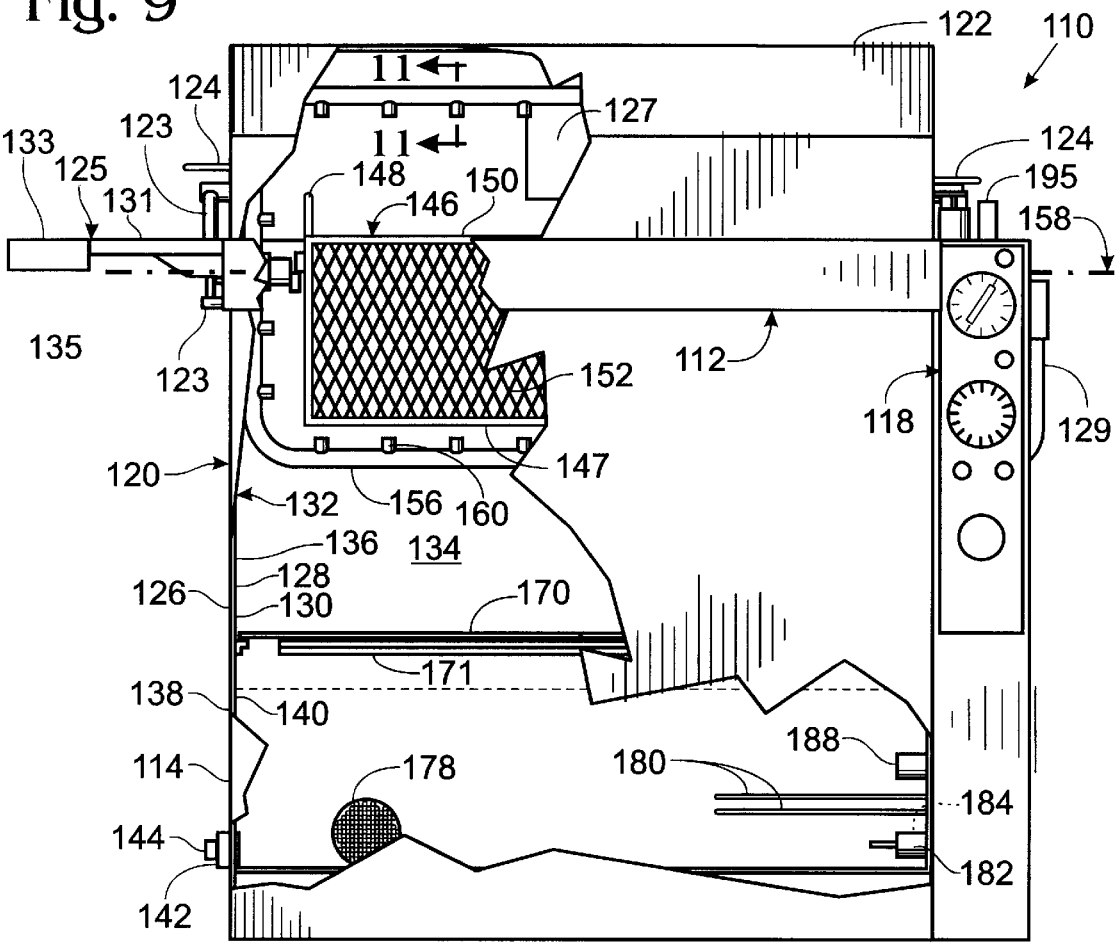
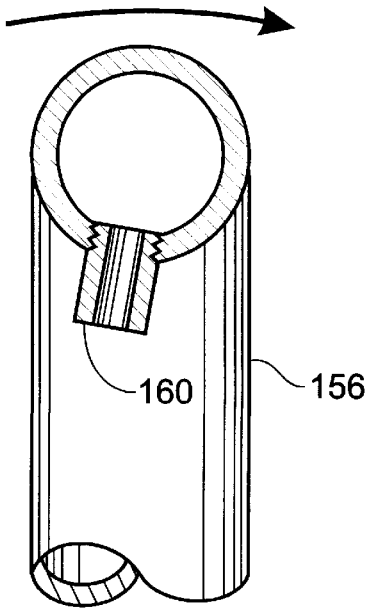
Fig. 11

PARTS WASHER

FIELD OF THE INVENTION

Invention relates generally to parts washers. More particularly, the invention relates to a parts washer with a fluid-propelled spray tube.

BACKGROUND

A parts washer is an apparatus that cleans machinery parts. Parts washers generally use an aqueous cleaning solution to remove such things as grease, carbon, resins, tar, inks, and other grime from duty palls like engine parts, tools, etc.

A conventional parts washer includes a rotating tray for supporting parts to be washed and a series of nozzles for directing the cleaning solution towards the parts on the tray. A pump delivers cleaning solution under pressure to the nozzles, which are fixedly mounted within the parts washer to direct cleaning solution at a particular region of the tray. A motor and a drive assembly are used to rotate the tray about a central axis. Because of the considerable weight of the tray and the parts to be washed, the motor and drive assembly must be of sufficient power and strength to cause the tray to rotate, even when loaded with parts to be washed. The motor and drive assembly is expensive and utilizes numerous parts that are subject to failure and require frequent maintenance.

It is an object of the invention described in this document to address this problem by providing a support structure for supporting parts to be washed and a fluid-propelled spray tube that rotates about the support structure and sprays cleaning fluid on the support structure and parts to be washed that are on the support structure.

A conventional parts washer often further includes a heater for increasing the temperature of the cleaning fluid. The temperature and level of the fluid within the parts washer must be carefully controlled to prevent damage to the pump and other equipment. Conventional controls are subject to fouling and damage while the parts washer is in use.

It is a further object of the invention described in this document to provide more reliable and effective temperature and level control for a parts washer by using a series of thermostats and pressure switches as controllers and as automatic safety shut-offs.

SUMMARY OF THE INVENTION

The invented parts washer includes a housing that has a washbasin. The washbasin defines an inner cavity and is chargeable with a volume of fluid. A spray tube is rotatably coupled to the housing and has an axis of rotation. The spray tube is configured to define a volume of rotation as it rotates about its axis of rotation. A support structure for supporting parts to be washed is positioned within the housing and is substantially within the volume of rotation of the spray tube. The parts washer further includes a pump for delivering fluid under pressure to the spray tube. The spray tube further includes a plurality of outlets configured to direct fluid substantially towards parts to be washed on the support structure and at least one outlet on the spray tube configured to direct fluid in a direction to cause fluid-propelled rotation of the spray tube about its axis of rotation.

In one embodiment of the invention, the support structure for supporting parts to be washed is completely within the volume of rotation of the spray tube. In a variation of the invention, the spray tube substantially encircles the support structure. In a further variation of the invention, the plurality of outlets are spaced along the spray tube to direct fluid at parts to be washed from substantially all directions as the spray tube rotates about its axis of rotation. In another variation of the invention, the parts washer includes at least two outlets on the spray tube configured to direct fluid in a direction to cause fluid-propelled rotation of the spray tube about its axis of rotation. In another variation of the invention, the parts washer includes at least two outlets on the spray tube configured to direct fluid in a direction to cause fluid-propelled rotation of the spray tube about its axis of rotation. In a further embodiment of the invention, all of the outlets on the spray tube are configured to direct fluid substantially towards parts to be washed on the support structure and to cause fluid-propelled rotation of the spray tube about its axis of rotation.

A further embodiment of the invention includes one of the previously described parts washers, only further including a strainer below the volume of rotation of the spray tube. The strainer catches larger pieces that fall off the support structure, or that are removed from parts as they are washed, and retains these pieces so they do not damage the pump or other elements of the parts washer. The strainer also facilitates the later visual inspection of these pieces. In a variation of this embodiment, the strainer is substantially coextensive with the support structure.

In another embodiment of the invention, the support structure of one of the previously described parts washers has a perforated base. The base allows fluid and debris to pass through the support structure. In another variation, the support structure is removably positioned within the housing. This facilitates the support structure being removed from the parts washer in order to load parts to be washed onto the support structure, and then replaced in the parts washer once parts to be washed are loaded. In a further variation of the invention, the washbasin includes a bottom portion, and the parts washer further includes a sump that is connected to the bottom portion of the washbasin. In this variation, the inlet port of the pump is connected to the sump.

Another embodiment of the invention involves one of the previously described parts washers, only further including a heater for heating fluid within the sump. In variations of the invention, the heater is at least partially within the sump. In other variations, the parts washer further includes a first thermostat for measuring the temperature of fluid within the parts washer and automatically disengaging the heater if the temperature of the fluid exceeds a defined maximum temperature and a second thermostat for controlling the heater to maintain the temperature of fluid within the parts washer between defined upper and lower temperatures.

A further embodiment of the invention involves one of the previously described parts washers, only further including a pressure switch within the sump for disengaging the pump and the heater if pressure from fluid in the parts washer is less than a defined minimum pressure.

Yet another embodiment of the invention includes a parts washer having a housing that includes a washbasin, which is chargeable with a volume of fluid. The parts washer further includes a support structure for supporting parts to be washed and a fluid-emitting apparatus configured to direct fluid towards parts to be washed. A pump is connected to the fluid-emitting apparatus. The parts washer further includes a pressure switch within the washbasin for automatically disconnecting the pump if pressure from fluid in the washbasin is below a defined minimum pressure. In a variation of this embodiment, the parts washer further includes a heater for heating fluid within the washbasin. In further variations of the invention, the parts washer includes a first thermostat for measuring the temperature of fluid within the washbasin and automatically disengaging the heater if the temperature of the fluid exceeds a defined maximum temperature and a second thermostat for controlling the heater to maintain the temperature of fluid in the washbasin between defined upper and lower temperatures. In other variations, the pressure switch also disengages the heater if the pressure from fluid in the washbasin is below a defined minimum pressure.

A further aspect of the invention comprises a method for washing parts. The method includes the steps of: (1) providing a parts washer that includes a housing having a washbasin, a spray tube rotatably coupled to the housing and having an axis of rotation and configured to define a volume of rotation as it rotates about its axis of rotation, a support structure removably positioned within the housing and substantially within the volume of rotation of the spray tube and configured to support parts to be washed, a pump for delivering fluid under pressure to the spray tube, a plurality of outlets on the spray tube configured to direct fluid substantially towards parts to be washed, and at least one outlet on the spray tube configured to direct fluid in a direction to cause fluid-propelled rotation of the spray tube about its axis of rotation; (2) charging the parts washer with a volume of fluid; (3) placing parts to be washed onto the support structure; (4) pumping fluid under pressure to the spray tube; (5) spraying fluid under pressure from the outlets on the spray tube substantially towards the parts to be washed on the support structure; and (6) emitting fluid under pressure from at least one outlet on the spray tube to cause fluid-propelled rotation of the spray tube about its axis of rotation.

A further method for washing parts includes the steps of: (1) providing a parts washer having a housing with a washbasin, a spray tube within and rotatably coupled to the housing and having an axis of rotation and configured to define a volume of rotation as it rotates about its axis of rotation, a support structure removably positioned within the housing and substantially within the volume of rotation of the spray tube and configured to support parts to be washed, a pump for delivering fluid under pressure to the spray tube, and a plurality of outlets on the spray tube that are configured to direct fluid substantially towards the parts to be washed on the support structure and to direct fluid in a direction to cause fluid-propelled rotation of the spray tube about its axis of rotation; (2) charging the parts washer with a volume of fluid; (3) placing parts to be washed onto the support structure; (4) pumping fluid under pressure to the spray tube; and (5) spraying fluid under pressure from the outlets on the spray tube substantially towards the parts to be washed on the support structure and in a direction to cause fluid-propelled rotation of the spray tube about its axis of rotation.

Variations of these methods involve preceding the loading step with the step of removing the support structure from the parts washer and following the loading step with the step of replacing the support structure into the parts washer.

Various other features, objects and advantages of the present invention will become fully apparent as this description continues.

BRIEF DESCRIPTION OF THE DRAWINGS

FIG. 9 is a front view of the parts washer shown in FIG. 8 with the cover closed and a portion of the housing and the cover broken away.

FIG. 11 is a cross-section view of the spray tube taken along 11—11 in FIG. 9.

DETAILED DESCRIPTION OF THE PREFERRED EMBODIMENTS

Figure 1:
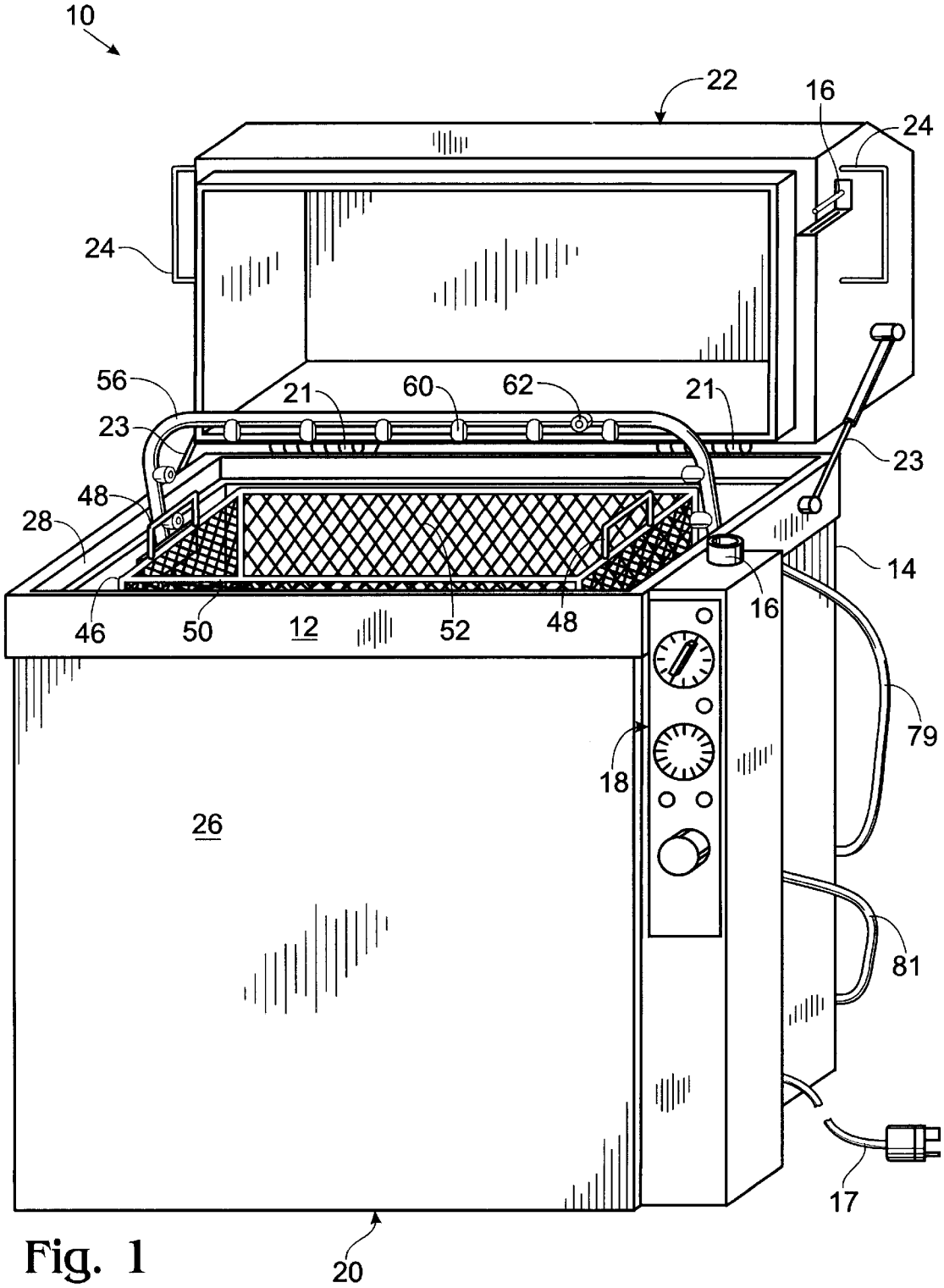
FIG. 1 is an isometric view of the invented parts washer with the cover open and the spray tube rotated to an upright position.

Referring now to the drawings, FIG. 1 depicts the parts washer of the invention, indicated generally at 10. The parts washer 10 has top and side regions, 12 and 14 respectively, and includes a housing 20. As shown in FIG. 1, the housing 20 has a cover 22, which is connected to the housing 20 by a pair of hinges 21. The cover may be opened and shut using handle portions 24 to provide and restrict access to the interior of the parts washer 10. A pair of hydraulic struts 23 are connected to the top region 12 of the housing 20 and the cover 22 and stabilize and support the cover 22 when it is raised to an open position.

The housing 20 further includes a solenoid safety latch 16, a control panel 18 and plural cover supports 25 (shown in FIGS. 3–6). The solenoid safety latch 16 is connected to the housing 20 and the cover 22 and prevents the cover 22 from being opened while the parts washer 10 is in use, as well as for a determined time period thereafter. The control panel 18 contains controls and indicators, including, but not limited to, status indicators, timers, temperature and wash cycle controls low fluid indicators and power switches. The control panel 18 is connected to a power supply (not shown) by a power cord 17. The pair of cover supports 25 further stabilize and support the cover 22 when it is raised to an open position. As shown in FIGS. 3–6, the cover supports 25 extend outwardly from the top region 12 of the housing 20 to provide a surface upon which the cover 22 may be supported.

The parts washer 10 shown in FIGS. 1–6 is a "top load" parts washer, with the cover 22 connected to the rest of the housing 20 to facilitate loading and unloading from the top region 12 of the parts washer 10. It should be understood that the present invention may be practiced using other configurations, such as a "side load" parts washer, where the cover is positioned to facilitate loading and unloading from one of the parts washer's side regions.

Figure 2:
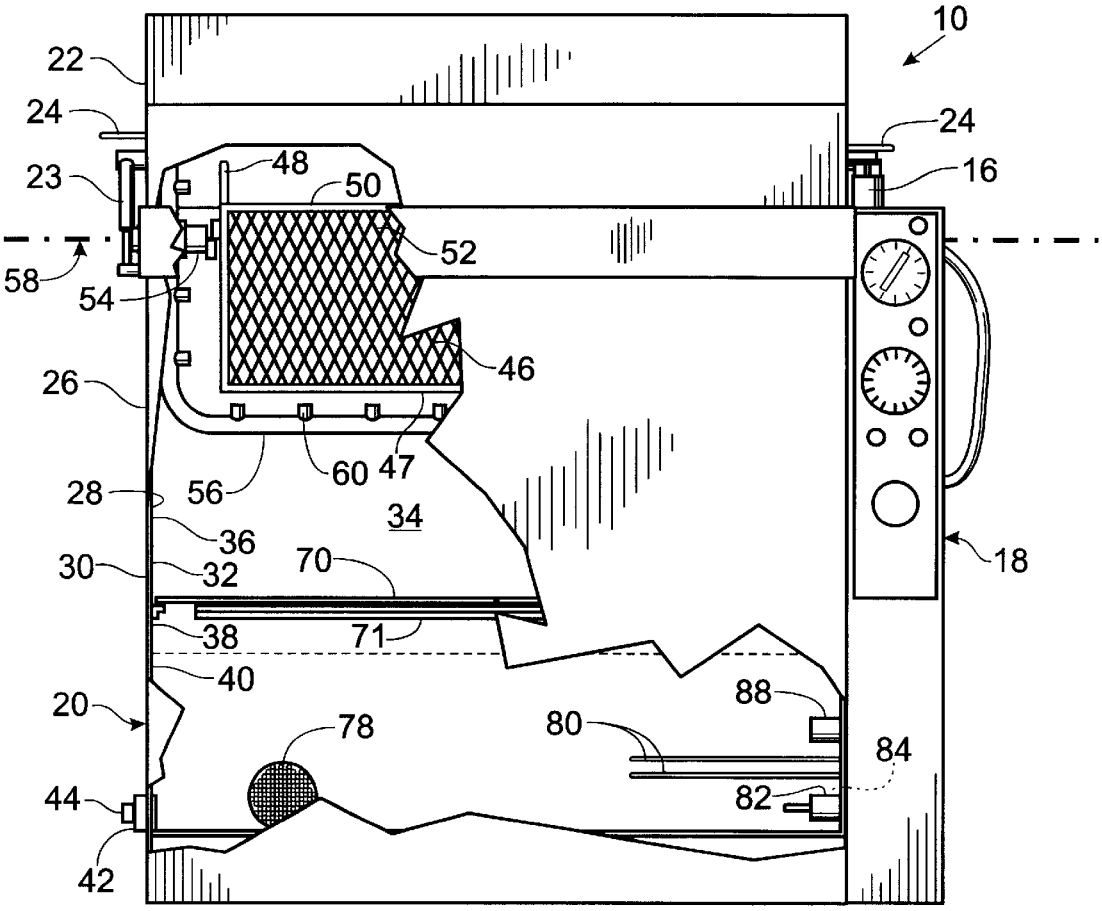
FIG. 2 is a front view of the parts washer shown in FIG. 1 with the cover closed and portions of the housing and the cover broken away.

As shown in FIG. 2, the housing 20 preferably includes an outer shell 26 and an inner shell 28 nested within the outer shell 26. The outer 26 and inner 28 shells cooperate to insulate the parts washer 10. Preferably, the outer 26 and inner 28 shells define an air-filled pocket 30 between the shells and substantially coextensive with the shells. More preferably, the pocket 30 is filled with foam or other suitable insulating material. The housing 20 may also be covered with an insulator, such as ceramic paint. The insulation increases the efficiency of the parts washer 10. The housing 20 is formed of a material that is not attacked by oil, grease, caustic soaps or solvents or similar materials, and does not deform under the parts washer's maximum operating temperature. Examples of such materials are steel and various hardened plastics. Nevertheless, the parts washer 10 may be made without an inner shell 28 or insulation between the inner and outer shells.

The housing 20 includes a washbasin 32 that defines an inner cavity 34 within the parts washer 10. In the preferred embodiment, the washbasin 32 is at least partially coextensive with the inner shell 28. The washbasin 10 may also be formed from the walls of the housing 20 themselves. As shown in FIG. 2, the washbasin 32 includes wall portion 36 and a bottom portion 38. The washbasin 32 is chargeable with a volume of cleaning fluid. The cleaning fluid should be of any suitable composition for removing grease, oil, grime and other residues and contaminants from the parts to be washed. Preferably, the fluid is an aqueous solution of water and an appropriate detergent. Suitable detergents are generally, although not exclusively, alkaline in nature. In some cases, however, it may be desirable simply to use water as the cleaning fluid. An example of a suitable detergent is Armakleen, which is manufactured by Church & Dwight Co.

Figure 5:
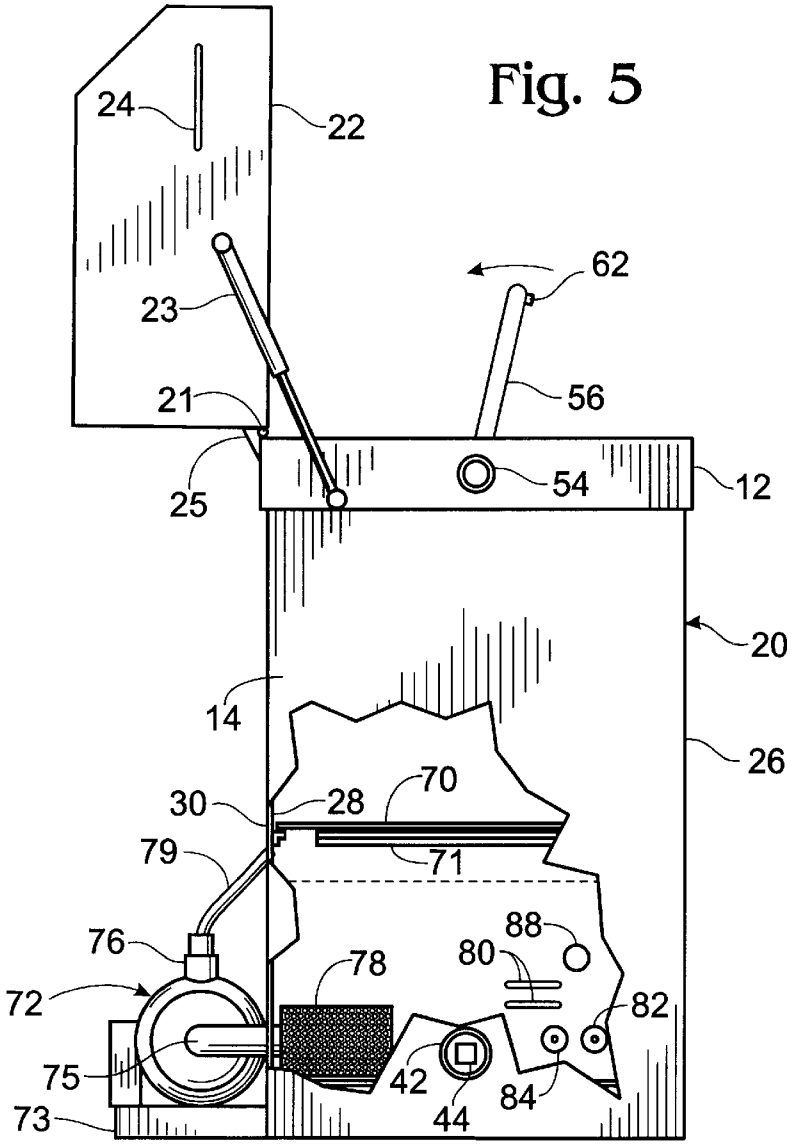
FIG. 5 is a left side view of the parts washer shown in FIG. 1 with the cover open, a portion of the housing broken away and spray tube rotated to a generally upright position.

The parts washer 10 further includes a sump 40 connected to the washbasin 32 for pooling and collecting the cleaning fluid. Preferably the sump 40 is connected to the bottom portion 38 of the washbasin 32. In the preferred embodiment, the sump 40 is integrally formed with the bottom portion 38 of the washbasin 32, as shown in FIGS. 2 and 5. Alternatively, the sump 40 could be positioned adjacent, yet still connected to, the washbasin 32. The sump 40 terminates at a drain 42, which extends through the housing 20 to facilitate the removal of cleaning fluid and debris from the parts washer 10. The drain 42 includes a valve or plug 44 for selectively closing the drain 42, as shown in FIGS. 2 and 5.

Figure 3:
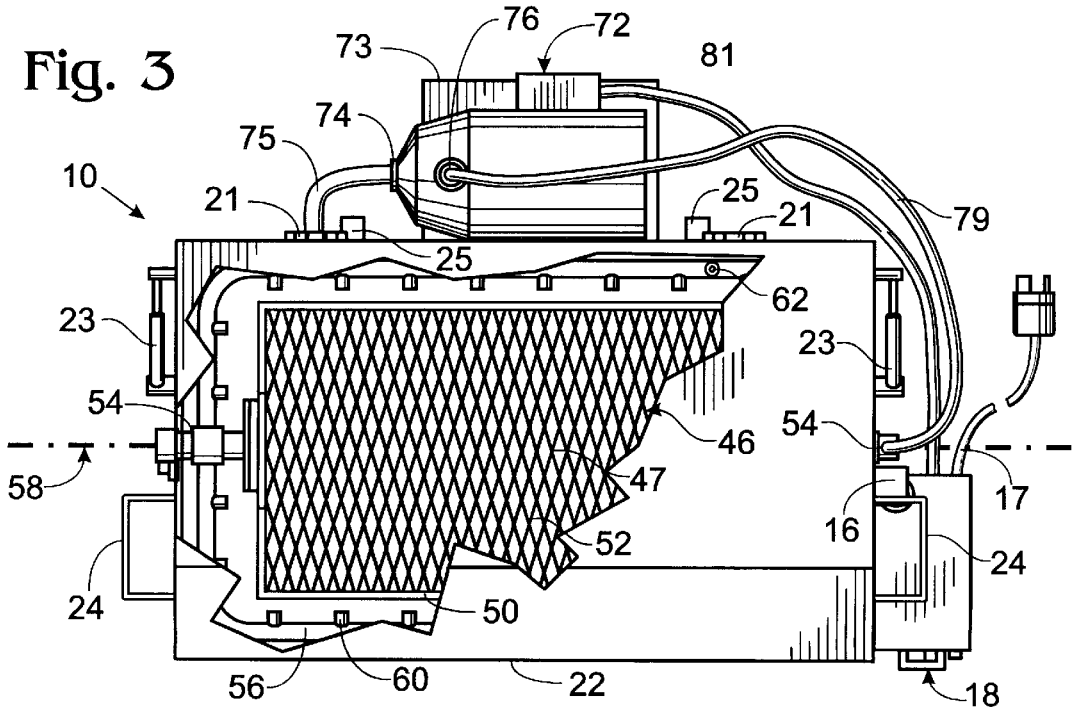
FIG. 3 is a top view of the parts washer shown in FIG. 1 with the cover closed, a portion of the housing broken away and the spray tube rotated to a horizontal position.

As shown in FIGS. 1–3 and 6, a support structure 46 for supporting parts to be washed is positioned within the housing 20. It should be understood that the support structure 46 may be a basket, tray, platform or any other suitable means for supporting parts to be washed. Preferably, the support structure 46 is removably positioned within the housing 20 to facilitate easier loading and unloading of parts to be washed onto the support structure. As shown in FIG. 3, the support structure 46 has a perforated base 47 that allows cleaning fluid to pass through the support structure 46. The perforation or apertures in the support structure 46 should be of sufficient size to allow pieces and particles, which are removed from parts as they are washed, to pass through the support structure 46. The support structure 46 may be constructed of any suitable material having sufficient strength to support parts to be washed without deforming, such as steel. It should be understood that the support structure 46 should be capable of supporting parts weighing several hundred pounds such as parts weighing at least 200 pounds.

As shown, the support structure 46 is a perforated basket comprised of a frame 50 and a lattice 52. The support structure 46 is removably received by plural mounts 54 that are connected to the housing 20. It should be further understood that the invention may be practiced using other single and plural mount systems connected to the housing 20, or that the support structure 46 could simply be placed within the washbasin 32. Other embodiments of the support structure 46 include, but are not limited to, a perforated basket with a perforated lid. This embodiment is particularly useful for washing smaller parts, which otherwise could be lost or removed from the support structure by the force of the cleaning fluid impinging on the parts. Another embodiment of the support structure 46 includes a stand or rack with a series of hooks, arms and/or restraints upon which parts to be washed are positioned.

The support structure 46 further includes handles 48 that facilitate the removal of the support structure 46 from the parts washer 10. The support structure 46 may be loaded with parts to be washed while it is connected to the housing 20. Alternatively, the support structure 46 may be removed from the parts washer 10, loaded with parts to be washed, and subsequently replaced in the parts washer 10.

A spray tube 56 is positioned within, and rotatably coupled to, the housing 20. The spray tube 56 has an axis of rotation 58 and is configured to define a volume of rotation as it rotates about its axis of rotation 58. The spray tube 56 is rotationally coupled to the plural mounts 54 intermediate the housing 20 and the support structure 46 as shown in FIGS. 1–3. Stainless steel, plastic, steel, or any other suitable durable material may be used to form the spray tube 56.

Support structure 46 is substantially within the volume of rotation of the spray tube 56. Preferably, the support structure 46 is completely within the volume of rotation of the spray tube 56. Even more preferably, the spray tube 56 substantially or completely encircles the support structure 46. As shown in FIGS. 1–3, the spray tube 56 has a generally rectangular configuration and completely encircles the support structure 46. Other configurations of spray tube are possible, including, but not limited to, a generally c-shaped or a generally j-shaped spray tube. Other single and plural mount systems are certainly possible that allow the spray tube 56 to rotate about a support structure 46 that is at least substantially within the volume of rotation of the spray tube 56. It should be understood that cross sections of any suitable geometric shape may be used. It should be further understood that, while a horizontally-mounted spray tube 56 is shown in FIGS. 1–3, a vertically-mounted spray tube 56 could also be used, especially with a side load parts washer.

The spray tube 56 includes a plurality of outlets 60 configured to direct fluid substantially towards parts to be washed on the support structure 46. Preferably, the plurality of outlets 60 are spaced along the spray tube 56 to direct fluid at parts to be washed on the support structure 46 from substantially all directions as the spray tube 56 rotates about its axis of rotation 58. Often, the outlets 60 are directed substantially towards the spray tube's axis of rotation 58.

As shown in FIGS. 1 and 5–7, the spray tube 56 further includes at least one outlet 62 on the spray tube 56 configured to direct fluid in a direction to cause fluid-propelled rotation of the spray tube 56 about its axis of rotation 58. Preferably, the spray tube 56 contains at least two outlets 62 on the spray tube 56 configured to direct fluid in a direction to cause fluid-propelled rotation of the spray tube 56 about its axis of rotation 58. This is accomplished by directing fluid generally tangential to the spray tube's 56 axis of rotation 58, thereby causing the spray tube 56 to spin or rotate. As shown in FIG. 5, the expulsion of fluid under pressure from outlets 62 causes the spray tube 56 to spin about its axis of rotation 58 in the direction indicated. It should be understood that the outlets 62 could alternatively be configured to cause fluid-propelled rotation of the spray tube 56 in the opposite direction. This fluid-propelled propulsion eliminates the need for a motor and drive assembly to be used to cause the spray tube 56 to spin or rotate.

The outlets 60 and 62 may be apertures in the spray tube 56. Alternatively, and more preferably, the outlets 60 and 62 are nozzles, spray jets or other suitable fluid-emitting devices that are connected to the spray tube 56. In the preferred embodiment, the direction and rate at which the outlets 60 and 62 direct fluid are adjustable.

The housing 20 includes a strainer 70 connected to the housing 20 below the volume of rotation of the spray tube 56. Preferably, the strainer 70 is substantially coextensive with the support structure 46. The strainer 70 includes a screen or chip tray that allows fluid to pass through, but retains pieces and particles that are removed from parts as they are washed. The strainer 70 is preferably positioned within the parts washer 10 so as to be within a user's reach once the support structure 46 is removed from the parts washer 10. This configuration allows a user to inspect the particles and pieces retained by the strainer 70.

As shown in FIGS. 2 and 5, the strainer 70 is positioned within the housing 20 intermediate the washbasin 32 and the sump 40. The strainer 70 is seated on a shoulder 71, which extends inwardly from the walls 36 of the washbasin 32. It should be understood that the strainer 70 may be positioned at various levels within the housing 20, so long as it is below the field of rotation of the spray tube 56. In alternate embodiments of the invention, the strainer 70 is removably connected to the housing 20 to facilitate the easy removal of the strainer 70 and subsequent inspection of the retained pieces and particles. The strainer 70 may also contain oil-absorbing pads to remove oil, grease, and other contaminants from fluid in the parts washer 10. It is also possible to place oil-absorbing pads in the sump 40 to absorb oils that accumulate in the sump 40.

Figure 6:
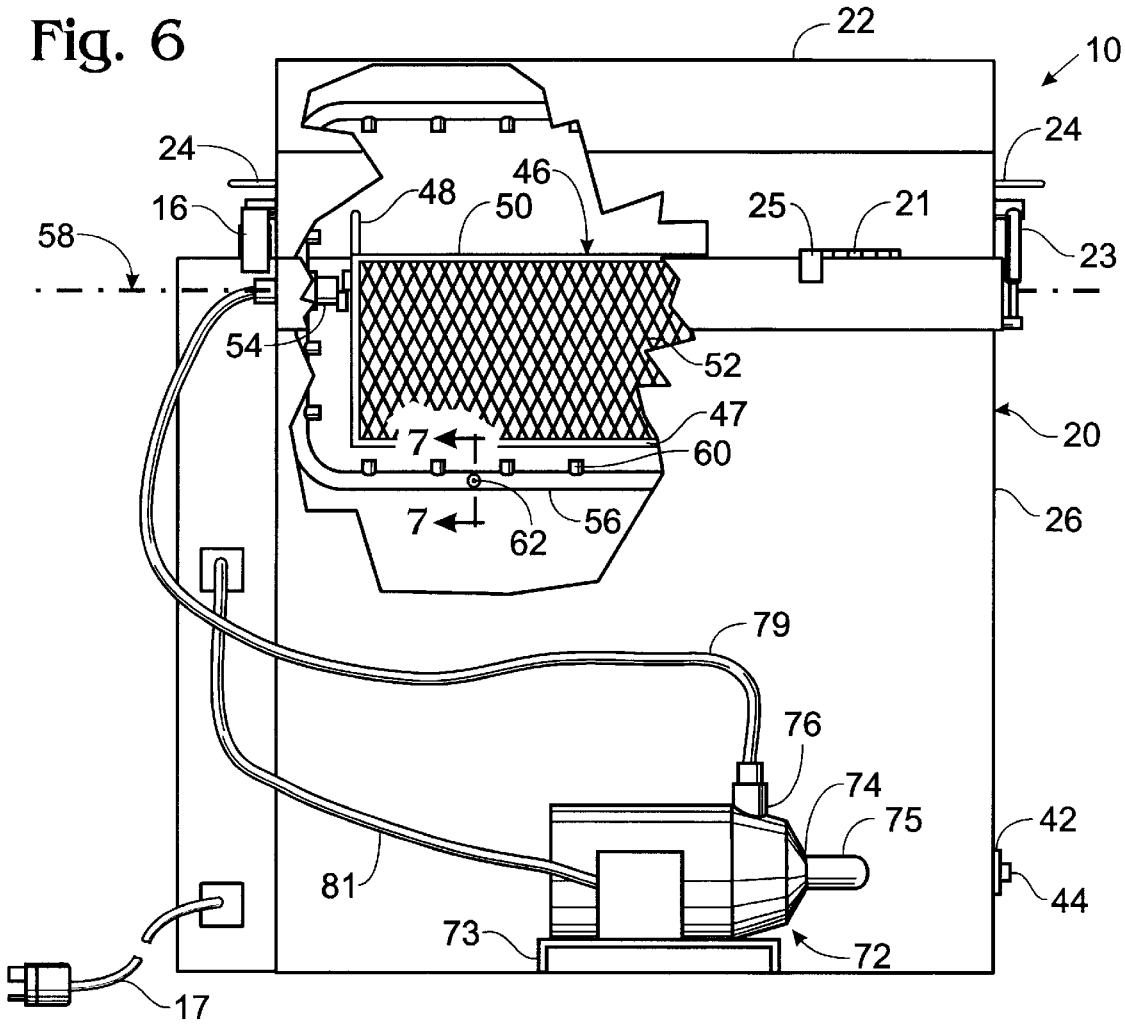
FIG. 6 is a rear view of the parts washer shown in FIG. 1 with the cover closed and portions of the housing and the cover broken away.
Figure 7:
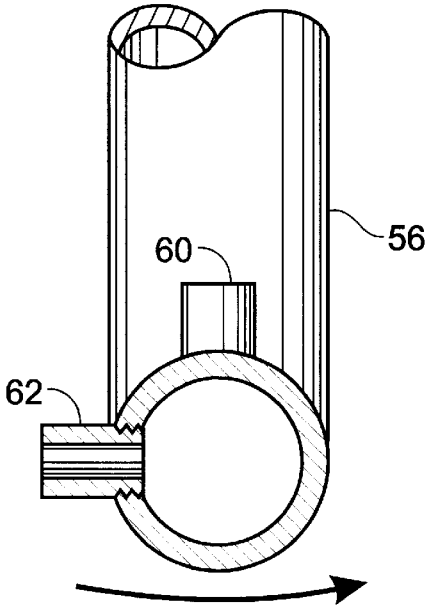
FIG. 7 is a cross-section view of the spray tube taken along line 7—7 in FIG. 6.

The parts washer 10 includes a pump 72 for delivering fluid under pressure to the spray tube 56. As shown in FIGS. 1, 3 and 6, wiring 81 electrically connects the pump 72 to the control panel 18, and member 73 extends from the housing 20 to provide a support for the pump 72 external the housing 20. The pump 72 includes an inlet port 74 for receiving fluid. As shown in FIGS. 3 and 5, the inlet port 74 is connected to the sump 40 by a first hose 75 or other suitable fluid conduit. This enables the pump 72 to intake fluid that has collected in the sump 40, thereby allowing a single charge of fluid to be used throughout a single, or even multiple, wash cycles. In this configuration, the parts washer 10 includes a strainer or filter 78 adjacent the inlet port 74 of the pump 72, as shown in FIGS. 2 and 5. The strainer or filter 78 is made of perforated metal or other suitable material for removing small particulates and other sediments from the cleaning fluid so that the pump 72 is not damaged. In other embodiments of the invention, the inlet port 74 of the pump 72 is connected to a fresh supply of fluid.

Figure 4:
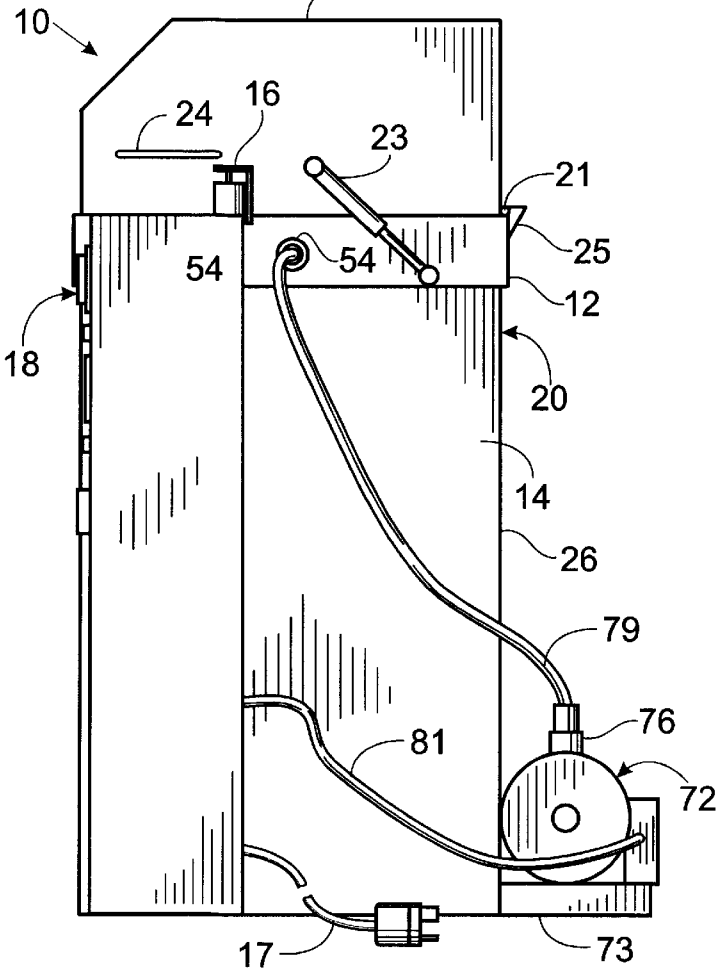
FIG. 4 is a right side view of the parts washer shown in FIG. 1 with the cover closed.

The pump 72 further includes an exit port 76 that is connected to the spray tube 56, as shown in FIGS. 3–5. A second hose 79 or other suitable fluid conduit is used to connect the exit port 76 and the spray tube 56. In use, the pump 72 delivers fluid under pressure through its exit port 76 to the spray tube 56. This fluid is subsequently expelled through the plurality of outlets 60 and 62 on the spray tube 56. Examples of suitable pumps 72 include, but are not limited to, centrifugal, jet, positive displacement and diaphragm pumps. As shown in FIGS. 3 and 6, the pump 72 is positioned external the housing 20 of the parts washer 10. Alternatively, the pump 72 may be contained within the housing 20.

As shown in FIGS. 2 and 5, the parts washer 10 may also contain a heater 80 for heating cleaning fluid within the parts washer 10. The heater 80 may be positioned adjacent the sump 40. Preferably, the heater 80 is at least partially within the sump 40. An example of a suitable heater is a heater with an incoloy-sheathed heating element manufactured by Chromalox, although it should be understood that many other styles and types of heaters are suitable for use in the invented parts washer.

The parts washer 10 may further include plural thermostats 82 and 84, as shown in FIGS. 2 and 5. The first thermostat 82 is configured to measure the temperature of fluid within the parts washer 10 and automatically disengage the heater 80 if the temperature of the fluid exceeds a defined maximum temperature. The first thermostat 82 preferably is positioned to measure the temperature of fluid in the sump 40. Alternatively, the first thermostat 82 could be positioned to measure the temperature of fluid in the parts washer 10 indirectly by measuring the temperature of the housing 20, washbasin 32 or sump 40. In operation, the first thermostat 82 is an automatic safety shut-off that protects the parts washer 10 from damage and deformation that would be caused if the cleaning fluid was heated above a defined maximum temperature. For most aqueous cleaning solutions, the defined maximum temperature is approximately 200° F. It should be understood that the defined maximum temperature may vary depending on the particular materials of construction used in the parts washer 10 and the composition of the cleaning fluid.

The second thermostat 84 is configured to control the heater 80 to maintain the temperature of the fluid between defined upper and lower temperatures. Preferably, the second thermostat 84 is positioned to measure the temperature of fluid in the sump 40. The second thermostat 84 maintains the temperature of the cleaning fluid within a defined temperature range while the parts washer 10 is in use. For most aqueous cleaning solutions, the defined temperature range is approximately 150–195° F. It should also be understood that temperatures outside of this range may be acceptable, depending on the particular materials of construction used in the parts washer 10 and the composition of the cleaning fluid. It should also be understood that the first and second thermostats 82 and 84 could use a common sensing element to measure the temperature of fluid in the parts washer 10.

The parts washer 10 may further include a pressure switch 88 for disengaging the pump 72 and the heater 80 if pressure from fluid in the parts washer 10 is less than a defined minimum pressure. The pressure switch 88 is an automatic safety shut-off that protects the parts washer 10, and especially the pump 72 and heater 80, from damage caused if the parts washer 10 is operated without a sufficient volume of cleaning fluid. In the preferred embodiment, the pressure switch 88 is a static pressure switch and measures the pressure of fluid within sump 40. It should be understood that if the pressure switch 88 is used in an embodiment of the parts washer 10 that does not contain a heater 80, then the pressure switch 88 merely disengages the pump 72 if the pressure of fluid in the parts washer 10 is less than a defined minimum pressure. All of the electrical components described above, including the thermostats, pressure switches, pumps, safety valves and heaters, may be electrically wired in any known manner.

Another embodiment of the invention is a parts washer that includes the previously described first and second thermostats 82 and 84 and pressure switch 88. The parts washer further includes the previously described housing 20, support structure 46 and pump 72. In this embodiment, the parts washer has a fluid-emitting apparatus configured to direct fluid towards parts to be washed on the support structure 46. This fluid-emitting apparatus may be any suitable apparatus for receiving fluid under pressure from the pump 72 and directing that fluid substantially towards parts to be washed on the support structure 46.

Alternate embodiments of the invented parts washer are shown in FIGS. 8–11. These embodiments contain, for the most part, the same elements and subelements as the previously described embodiments.

Figure 8:
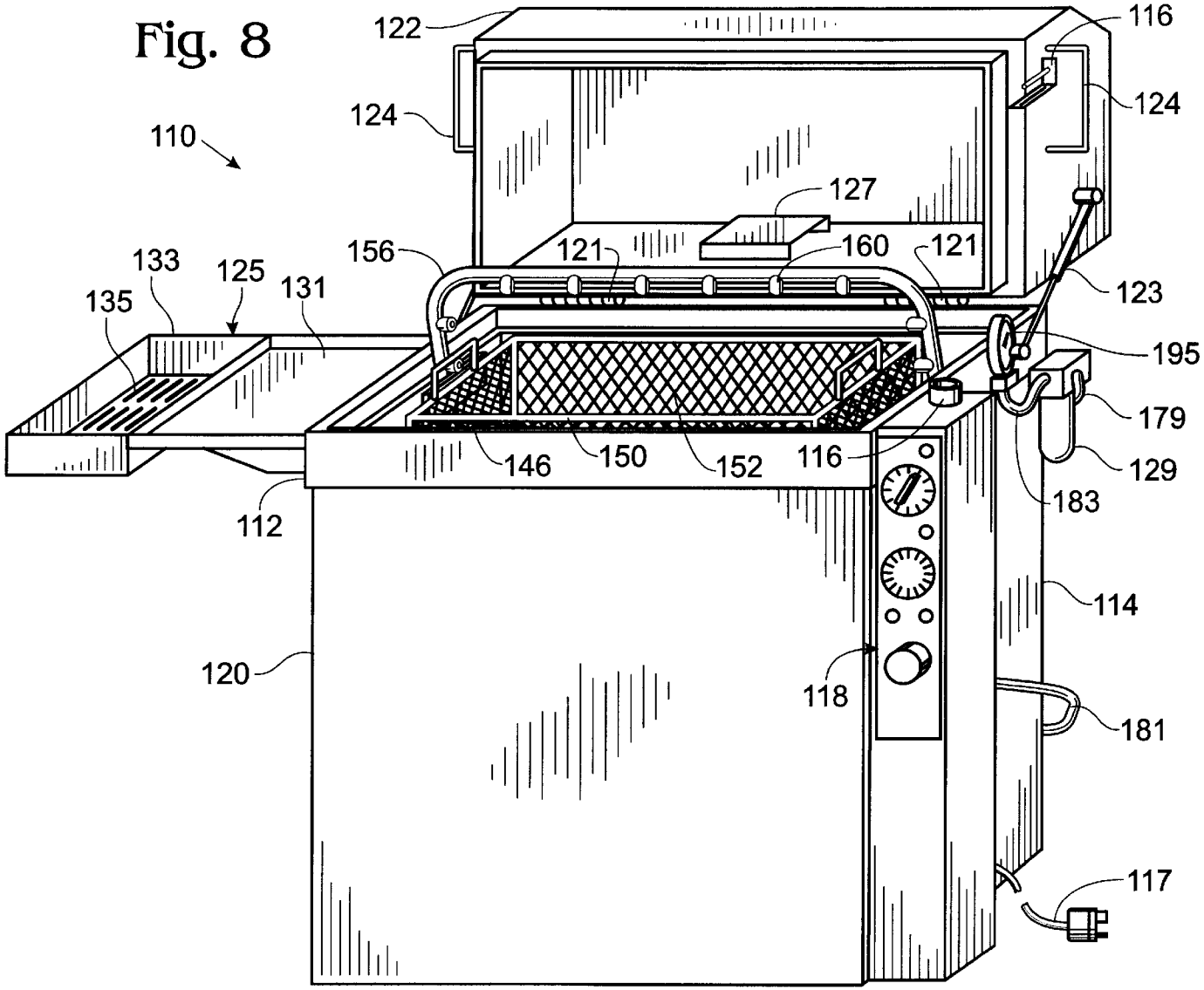
FIG. 8 is an isometric view of an alternate embodiment of the invented parts washer with the cover open and the spray tube rotated to an upright position.
Figure 10:
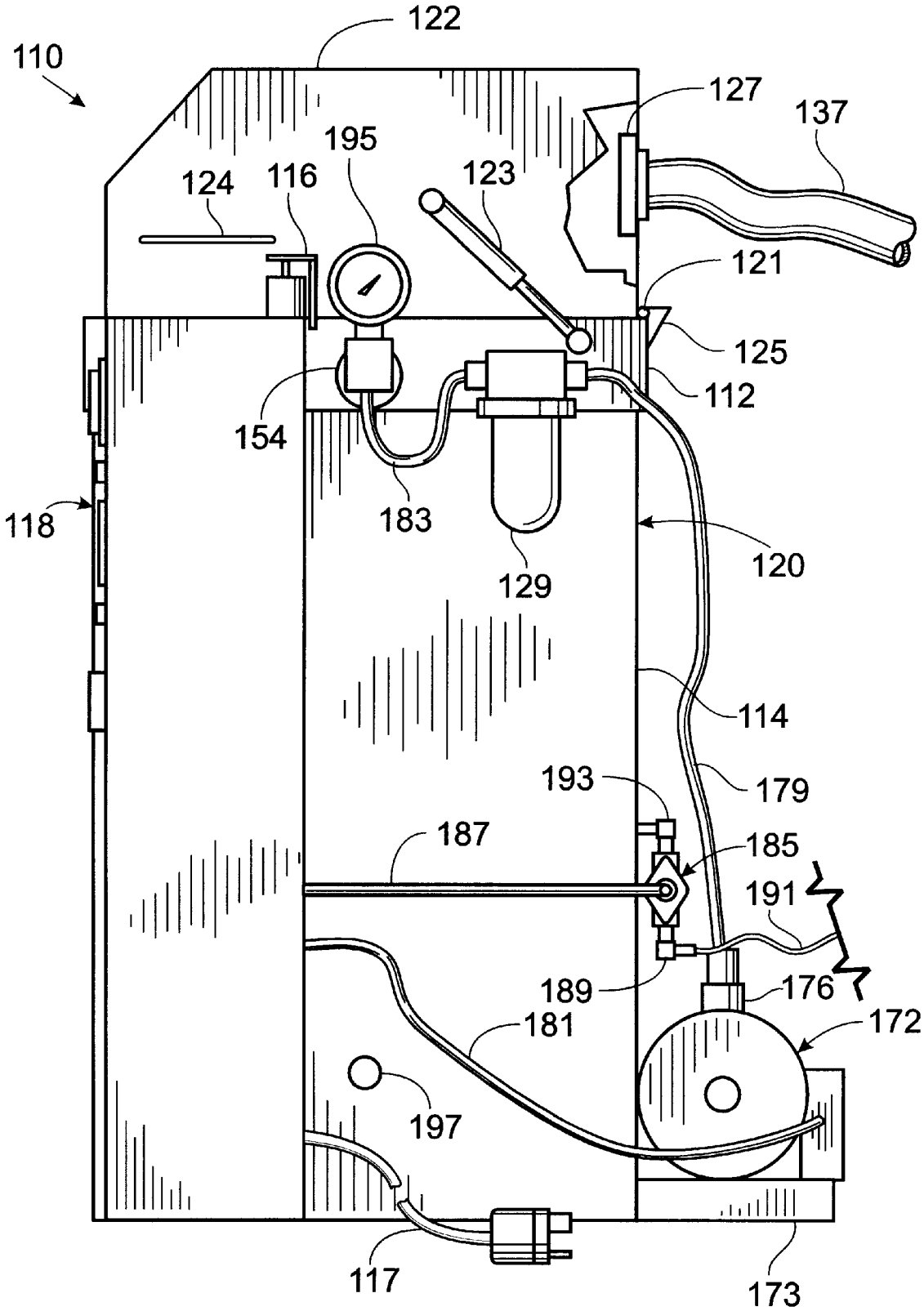
FIG. 10 is a night side view of the parts washer shown in FIG. 8 with the cover closed and a portion of the cover broken away.

In FIGS. 8–10, a parts washer is generally indicated at 110 and includes top and side regions 112 and 114, respectively. The parts washer 110 has a housing 120 that includes a cover 122. The cover 122 is connected to the housing 120 by a pair of hinges 121 and is opened and closed using handle portions 124. A pair of hydraulic struts 123 and cover supports 125 (FIG. 11) stabilize and support the cover 122 when it is raised to an open position. The housing 120 includes a control panel 118 mounted on the side region 114 of the housing 120 and connected to a power supply by power cord 117. A solenoid safety latch 116 is connected to the housing 120 and the cover 122.

The parts washer preferably includes outer and inner shells 126 and 128, which define pocket 130. The housing 120 includes a washbasin 132 that defines an inner cavity 134 within the parts washer 110. The washbasin includes walls 136 and bottom portion 138 and is chargeable with a volume of fluid. The parts washer 110 fniiher includes a sump 140, a strainer 170 seated on a shoulder 171 extending outwardly from the housing 120, a pump 172 seated on a member 173 and having an inlet port 174 and an exit port 176, first and second hoses 175 and 179, wiring 181, a drain 142 and a valve 144.

A support structure 146 for supporting palls to be washed is removably seated on plural mounts 154. A spray tube 156 is positioned within the housing 120 and rotatably coupled to the plural mounts 154 intermediate the support structure 146 and the housing 120. The spray tube 156 contains a plurality of outlets 160.

The plurality of outlets on 160 on the spray 156 are configured to direct fluids substantially towards parts to be washed on the support structure 146 and to cause fluid-propelled rotation of the spray tube 156 about its axis of rotation 158. As shown in FIG. 11, the plurality of outlets 160 are radially offset from the plane of the spray tube 156 by approximately 10°. This facilitates the plurality of outlets 160 both to wash parts on the support structure 146 and to cause fluid-propelled rotation of the spray tube 156 about its axis of rotation 158. It should be understood that the invention may be practiced using larger or smaller degrees of offset, so long as the plurality of outlets 160 are still able to wash parts on the support structure 146 as well as to cause fluid-propelled rotation of the spray tube 156 about its axis of rotation 158. Additionally, it would also be possible to provide a spray tube containing the radially offset plurality of outlets 160 as well as at least one outlet configured primarily to cause fluid-propelled rotation of the spray tube about its axis of rotation.

As shown in FIG. 8, the parts washer 110 further includes a service tray 125, a baffle 127 and a filtration system 129. The service tray 125 is connected to the top region 112 of the housing 120. Service tray 125 includes a tray region 131 and a basket region 133. Preferably, the basket region has a perforated bottom 135. The service tray 125 is used for inspecting and drying parts, as well as for providing a convenient depository for hand tools that may be used to adjust the parts washer 110 or to scrub burned on or encrusted deposits on parts on the support structure 146.

Baffle 127 is removably connected to the cover 122 of the parts washer 110. As shown in FIG. 10, baffle 127 may be coupled with an exhaust pipe 137 to provide a hot air exhaust system for the parts washer 110.

The filtration system 129 removes very fine debris and solids from fluid as it is pumped to the spray tube 156. This additional filtration extends the life of fluid used in the parts washer 110 and reduces the possibility of fouling or clogging the spray tube 156 or the plurality of outlets 160 on the spray tube 156. As shown, the filtration system 129 receives fluid under pressure from the second hose 179, which is connected to the exit port 176 of the pump 172. The filtration system 129 includes filters that remove dirt and debris from the fluid. Preferably, the filtration system 129 includes stainless steel strainer filters that remove debris and solids as small as 50 microns. Fluid under pressure passes through the filtration system 129 to the spray tube 156 via a third hose 183 or other suitable fluid conduit that connects the filtration system 129 and the spray tube 156. As shown, the filtration system 129 is mounted external the top region 112 of the parts washer 110. This facilitates easy removal and cleaning of the filtration system 129.

As shown in FIG. 10, the parts washer may further include an automatic water fill 185. As shown, the automatic water fill 185 is electrically connected to the control panel 118 by cable 187. The automatic water fill has an inlet 189 that is connected to a supply of fluid (not shown) by a fourth hose 191. The automatic water fill 185 further includes an exit 193 that extends through the housing 120 of the parts washer 110, thereby facilitating the addition of fluid to the parts washer 110. Preferably, the exit 193 delivers fluid to the sump 140 of the parts washer 110. The automatic water fill 185 is activated by the pressure switch 88. By automatically adding fluid to the parts washer 110, the automatic water fill 185 eliminates the need to turn off the parts washer 110 if die level of fluid drops below a defined minimum level while the parts washer 110 is in use.

As shown in FIG. 10, the parts washer 110 includes a pressure gauge 195 and a temperature gauge 197. The pressure 195 and temperature 197 gauges display the pressure and temperature, respectively, of fluid in the parts washer 110. As shown, the temperature gauge 197 is mounted on the side region 114 of the parts washer 110 and directly or indirectly measures the temperature of fluid in the parts washer 110. The pressure gauge 195 is mounted to the top region 112 of the housing 120 and measures the pressure of fluid being delivered to the spray tube 156. It should be understood that many other suitable locations exist where the pressure gauge 195 and the temperature gauge 197 can be mounted to respectively measure and display the pressure and temperature of fluid in the parts washer 110.

It should be further understood that the previously described service tray 125, baffle 127, filtration system 129, spray tube 156, automatic water fill 185, pressure gauge 185 and temperature gauge 197 may all be incorporated into the embodiment of the invented parts washer shown in FIGS. 1–7.

METHOD OF USING THE INVENTION

To use the parts washer 10 shown in FIG. 1, the parts washer 10 is first charged with a volume of fluid. The fluid should be selected based on the type and condition of the parts to be washed. Next, parts to be washed are loaded onto the support structure 46. The fluid is then received into the pump 72 through the pump's inlet port 74. The pump 72 subsequently delivers fluid under pressure through its exit port 76 to the spray tube 56. The fluid under pressure is next sprayed from the outlets 60 on the spray tube 56 substantially towards the parts to be washed on the support structure 46 and emitted from at least one outlet 62 on the spray tube 56 to cause fluid-propelled rotation of the spray tube 56 about its axis of rotation. This results in fluid being directed at parts to be washed on the support structure 46 from substantially all directions.

A variation of the method may include the step of removing the support structure 46 from the parts washer 10 prior to loading parts to be washed onto the support structure 46. This enables the support structure 46 to be carried to the parts to be washed. This is especially convenient when the parts to be washed are not all centrally located. After loading the parts to be washed, the support structure 46 is replaced into the parts washer 10.

It should be understood that the embodiments of the parts washer shown in FIGS. 8–11 may be used by following the method described above, however the plurality of outlets are configured to direct fluid substantially towards parts to be washed on the support structure and to direct fluid in a direction to cause fluid-propelled rotation of the spray tube about its axis of rotation.

INDUSTRIAL APPLICABILITY

The invented parts washer and method are applicable in any situation where mechanical parts or equipment need to be cleaned. It is particularly applicable for washing industrial or automotive parts.

While a preferred embodiment of the invented parts washer and method have been disclosed, changes and modifications can be made without departure from the spirit of the invention.

We claim:

1. A parts washer for washing parts, comprising:

a housing having a washbasin, wherein the washbasin defines an inner cavity and is chargeable with a volume of fluid;

a spray tube within the housing and rotatably coupled to the housing, wherein the spray tube has an axis of rotation and is configured to define a volume of rotation as it rotates about its axis of rotation;

a support structure configured to support parts to be washed, wherein the support structure is positioned within the housing and is at least substantially within the volume of rotation of the spray tube;

a plurality of outlets on the spray tube configured to direct fluid substantially towards parts to be washed on the support structure;

at least one outlet on the spray tube configured to direct fluid in a direction to cause fluid-propelled rotation of the spray tube about its axis of rotation;

a sump adapted to collect fluid dispensed from the outlets;

a pump adapted to receive fluid from the sump and deliver fluid under pressure to the spray tube;

a heater adapted to heat fluid in the sump;

a first thermostat for measuring the temperature of fluid within the parts washer and for automatically disengaging the heater if the temperature of the fluid exceeds a defined maximum temperature;

a second thermostat for controlling the heater to maintain the temperature of fluid in the parts washer between defined upper and lower temperatures; and a pressure switch within the sump for disengaging the pump and the heater if pressure from fluid in the sump is less than a defined minimum pressure.

2. The parts washer of claim 1, wherein the spray tube at least substantially encircles the support structure.

3. The parts washer of claim 1, wherein the plurality of outlets are spaced along the spray tube to direct fluid at parts to be washed from substantially all directions as the spray tube rotates about its axis of rotation.

4. The parts washer of claim 1, further comprising at least two outlets on the spray tube configured to direct fluid in a direction to cause fluid-propelled rotation of the spray tube about its axis of rotation.

5. The parts washer of claim 1, wherein all of the outlets on the spray tube are configured to direct fluid substantially towards parts to be washed on the support structure and to cooperate to cause fluid-propelled rotation of the spray tube in a determined direction about its axis of rotation.

6. The parts washer of claim 1, further comprising a strainer below the volume of rotation of the spray tube and at least substantially coextensive with the support structure.

7. The parts washer of claim 1, wherein the support structure has a perforated base.

8. The parts washer of claim 1, wherein the support structure is removably positioned within the housing.

9. The parts washer of claim 1, wherein the heater is at least partially within the sump.

10. The parts washer of claim 1, further comprising a pressure switch within the sump for disengaging the pump and the heater if pressure from fluid in the sump is less than a defined minimum pressure.

11. The parts washer of claim 1, wherein the spray tube completely encircles the support structure.

12. The parts washer of claim 1, wherein the spray tube has a substantially horizontal axis of rotation.

13. The parts washer of claim 1, further comprising a latch adapted to prevent access to the washbasin while the parts washer is in operation.

14. The parts washer of claim 13, wherein the latch is adapted to prevent access to the washbasin while the parts washer is in operation and for a defined time period thereafter.

15. The parts washer of claim 1, wherein at least one of the plurality of outlets is adjustable to control at least one of the rate and the direction at which fluid is dispensed therefrom.

16. The parts washer of claim 1, wherein all of the outlets are adjustable to control at least one of the rate and the direction at which fluid is dispensed therefrom.

17. A parts washer for washing parts, comprising:

a housing having a washbasin, wherein the washbasin is chargeable with a volume of fluid;

a support structure configured to support parts to be washed;

a fluid-emitting apparatus configured to direct fluid substantially towards parts to be washed;

a pump connected to the fluid-emitting apparatus;

a heater;

a first thermostat for measuring the temperature of fluid within the parts washer and for automatically disengaging the heater if the temperature of the fluid exceeds a defined maximum temperature;

a second thermostat for controlling the heater to maintain the temperature of fluid in the pats washer between defined upper and lower temperatures; and a pressure switch within the washbasin for automatically disengaging the pump and the heater if pressure from fluid in the washbasin is below a defined minimum pressure.

18. The parts washer of claim 17, wherein the fluid-emitting apparatus is rotatable about an axis of rotation and includes a plurality of outlets, and further wherein at least one of the plurality of outlets is adapted to cause fluid-propelled rotation of the apparatus about the axis of rotation when fluid is dispensed from the at least one of the plurality of outlets.

19. The parts washer of claim 17, wherein the fluid-emitting apparatus is rotatable about an axis of rotation and includes a plurality of outlets, and further wherein at least one of the plurality of outlets is adapted to cause fluid-propelled rotation of the apparatus about the axis of rotation when fluid is dispensed from the at least one of the plurality of outlets.

20. A parts washer for washing parts, comprising:

a housing having a wash chamber, a top region with a selectively closeable opening through which parts to be washed may be loaded into and removed from the parts washer, and a cover adapted to selectively close the opening in the top region, wherein the parts washer is chargeable with a volume of fluid and the washbasin includes generally opposed side walls;

a pair of generally opposed mounts extending into the wash chamber from the side walls;

a spray tube within the housing and rotatably coupled to the housing by the mounts, wherein the spray tube has a horizontal axis of rotation which extends through the mounts, and further wherein the spray tube is configured to define a volume of rotation as it rotates about its axis of rotation;

a perforated support structure adapted to support tools, mechanical parts and machinery collectively weighing at least 200 pounds, wherein the support structure includes a perforated lower surface, and further wherein the support structure is supported within the volume of rotation of the spray tube by the mounts;

a plurality of outlets on the spray tube configured to direct fluid substantially towards parts to be washed on the support structure;

at least one outlet on the spray tube configured to direct fluid in a direction to cause fluid-propelled rotation of the spray tube about its axis of rotation; and a pump adapted to deliver fluid under pressure to the spray tube, wherein fluid under pressure from the pump is delivered to the spray tube through one of the mounts.

21. The parts washer of claim 20, wherein the plurality of outlets includes a plurality of apertures in the spray tube.

22. The parts washer of claim 20, wherein the plurality of outlets includes a plurality of nozzles.

23. The parts washer of claim 20, wherein at least one of the plurality of outlets is adjustable to control at least one of the rate and direction at which fluid is dispensed therefrom.

24. The parts washer of claim 20, wherein at least a substantial portion of the plurality of outlets are configured to direct fluid in a direction to cause fluid-propelled rotation of the spray tube about its axis of rotation.

25. The parts washer of claim 20, wherein all of the plurality of outlets on the spray tube are configured to direct fluid in a direction to cause fluid-propelled rotation of the spray tube about its axis of rotation.

26. The parts washer of claim 20, wherein the support structure includes portions extending upwardly from all sides of the lower surface.

27. The parts washer of claim 20, wherein the support structure includes a perforated basket with a perforated base and perforated side walls extending therefrom.

28. The parts washer of claim 27, wherein the perforated basket includes a perforated lid.

29. The parts washer of claim 20, wherein the spray tube completely encircles the support structure.

30. The parts washer of claim 29, wherein the spray tube has a generally rectangular configuration.

31. The parts washer of claim 20, further comprising a heater and a temperature sensor adapted to detect the temperature of the fluid within the parts washer.

32. The parts washer of claim 31, further comprising a thermostat in communication with the temperature sensor and adapted to maintain the temperature of fluid in the parts washer between defined upper and lower temperatures.

33. The parts washer of claim 20, wherein the support structure is selectively removable from the parts washer.

* * * * *

UNITED STATES PATENT AND TRADEMARK OFFICE

CERTIFICATE OF CORRECTION

PATENT NO : 6,109,277

DATED : August 29, 2000

INVENTOR(S): Paul W. Linton, Bill George Epperson, Jr., Hal W. Hardinge and David Alan Bergerud It is certified that error appears in the above-identified patent and that said Letters Patent is hereby corrected as shown below:

In column 1, line 13, please delete "duty palls" and insert --dirty parts-- therefor.

In column 4, line 24, please delete "night" and insert --right-- therefor.

In column 9, line 37, please delete "fniiher" and insert --further-- therefor.

In column 9, line 43, please delete "palls" and insert --parts-- therefor.

In column 10, line 45, please delete "die" and insert --the-- therefor.

UNITED STATES PATENT AND TRADEMARK OFFICE

CERTIFICATE OF CORRECTION

PATENT NO : 6,109,277

DATED : August 29, 2000

INVENTOR(S): Paul W. Linton, Bill George Epperson, Jr., Hal W. Hardinge and David Alan Bergerud It is certified that error appears in the above-identified patent and that said Letters Patent is hereby corrected as shown below:

In column 13, line 30, please delete "washbasin" and insert --wash chamber-- therefor.

Signed and Sealed this

Twentieth Day of March, 2001

Nicholas P. Godici

*Attest:*

NICHOLAS P. GODICI

*Attesting Officer*

*Acting Director of the United States Patent and Trademark Office*